US005251705A

United States Patent [19]

Waggoner et al.

[11] Patent Number: 5,251,705

[45] Date of Patent: Oct. 12, 1993

[54] ELECTRICAL TRIGGER FOR QUICK DROP VALVE

[75] Inventors: Van E. Waggoner; Donald E. McGovern, both of Dubuque, Iowa

[73] Assignee: Deere & Company, Moline, Ill.

[21] Appl. No.: 854,509

[22] Filed: Mar. 19, 1992

[51] Int. Cl.[5] ..... E02F 3/85; F15B 13/04

[52] U.S. Cl. ..... 172/812; 91/439; 91/436; 91/461

[58] Field of Search ..... 37/DIG. 1, DIG. 14; 172/812, 828, 830, 663; 91/430–439, 461

[56] References Cited

U.S. PATENT DOCUMENTS

| | | | |
|---|---|---|---|
| 3,335,739 | 8/1967 | Rice | 91/436 |
| 3,448,685 | 6/1969 | Kroth | 91/436 |
| 3,494,258 | 2/1970 | Harms et al. | 91/451 |
| 3,568,207 | 3/1971 | Slone | 91/436 |
| 3,604,313 | 9/1971 | Fruehauf | 91/436 |
| 3,795,177 | 3/1974 | Cryder et al. | 91/436 |
| 3,805,678 | 4/1974 | Bianchetta et al. | 91/461 |
| 3,960,059 | 6/1976 | Schexnayder | 172/812 |
| 3,965,587 | 6/1976 | Johns, Jr. | 91/436 |
| 4,024,796 | 5/1977 | Theobald | 91/437 |
| 4,397,221 | 8/1983 | Friesen et al. | 91/436 |
| 4,717,502 | 11/1983 | Slone | 91/445 |
| 4,732,076 | 3/1988 | Ewald | 91/420 |
| 4,770,083 | 9/1988 | Johnson | 91/461 |
| 5,014,734 | 5/1991 | Smith | 137/117 |

FOREIGN PATENT DOCUMENTS 94003 7/1980 Japan .

OTHER PUBLICATIONS

Caterpillar publication, Specifications for D6H Tractor Hydraulics, 10 pages.

Publication on a FD14E Crawler Tractor, Service Manual, 5 pages.

Parts Manual publication for Model TD-15E S/N 8001 and Up Crawler Tractor, Form 1128 201 H1, Jun. 1988.

*Primary Examiner*—Dennis L. Taylor

*Assistant Examiner*—Spencer Warnick

[57] ABSTRACT

A quick drop valve is electrically actuated by a switch located adjacent to the implement positioning control lever. The quick drop valve is a pilot operated spring biassed valve. When the electric switch is closed a solenoid valve is energized redirecting fluid between the pilot control lines. The quick drop valve is shifted short circuiting the flow of fluid from the lift side of the hydraulic cylinder to the reservoir and redirects it to the drop side of the hydraulic cylinder for quickly dropping the working implement.

12 Claims, 3 Drawing Sheets

ELECTRICAL TRIGGER FOR QUICK DROP VALVE

BACKGROUND OF THE INVENTION

1. Field of the Invention

The invention is directed to the hydraulic circuitry for an electrically actuated quick drop valve.

2. Description of the Prior Art

Large construction machines, such as bulldozers, use quick drop valves to quickly lower working implements. This allows the operator to quickly reposition the implement for the next operation and also to execute a "drop-and-catch" procedure to clear the implement of material adhering to the implement.

Typically these quick drop valves are spring biassed pilot operated valves. The valve spool is hydraulically balanced between two pilot control lines. One of the pilot lines is provided with a restriction so that there is a pressure differential between the two pilot control lines. A spring biasses the spool into a first position which allows the flow of fluid from the control valve to the hydraulic cylinder. As an operator actuates the blade control lever, to more quickly lower the blade, hydraulic pressure increases in the pilot control lines until the pressure in the control line opposite the spring overcones the spring and shifts the valve into a second position. In the second position the quick drop valve short circuits the flow of fluid from the lift side of the hydraulic cylinder to the reservoir and redirects it to the drop side of the hydraulic cylinder for quickly dropping the blade.

One problem of quick drop valves of the above-described configuration is that they are pressure, flow and viscosity sensitive. Therefore the exact shifting of the valve is not predictable.

Another deficiency is any differential pressure of sufficient magnitude to overcome the biassing spring will cause the valve to shift which may result in unexpected motion of the implement.

SUMMARY

It is an object of the present invention to provide a quick drop valve that is consistently responsive in all conditions.

It is a feature of the present invention that the quick drop valve is triggered by an electrical signal.

The quick drop valve of the present invention comprises a pilot operated spring biassed valve having a first position and a second position. In its first position, the quick drop valve passes fluid directly between the control valve and the hydraulic cylinders. In its second position, the quick drop valve short circuits the flow of fluid from the lift side of the hydraulic cylinder to the reservoir and redirects it to the drop side of the hydraulic cylinder for quickly dropping the blade. The valve is triggered by an electrical signal from a switch located adjacent to the control lever. As the lever is moved to its full down position the switch is closed and the quick drop valve shifted.

The switch directs electrical energy from a source of electrical energy to a two-position spring biassed solenoid valve which controls the flow of fluid through the pilot lines of the quick drop valve. The solenoid valve causes a pressure differential in the pilot lines so that the force of the biassing spring is overcome and the quick drop valve shifted.

DETAILED DESCRIPTION

Figure 1:
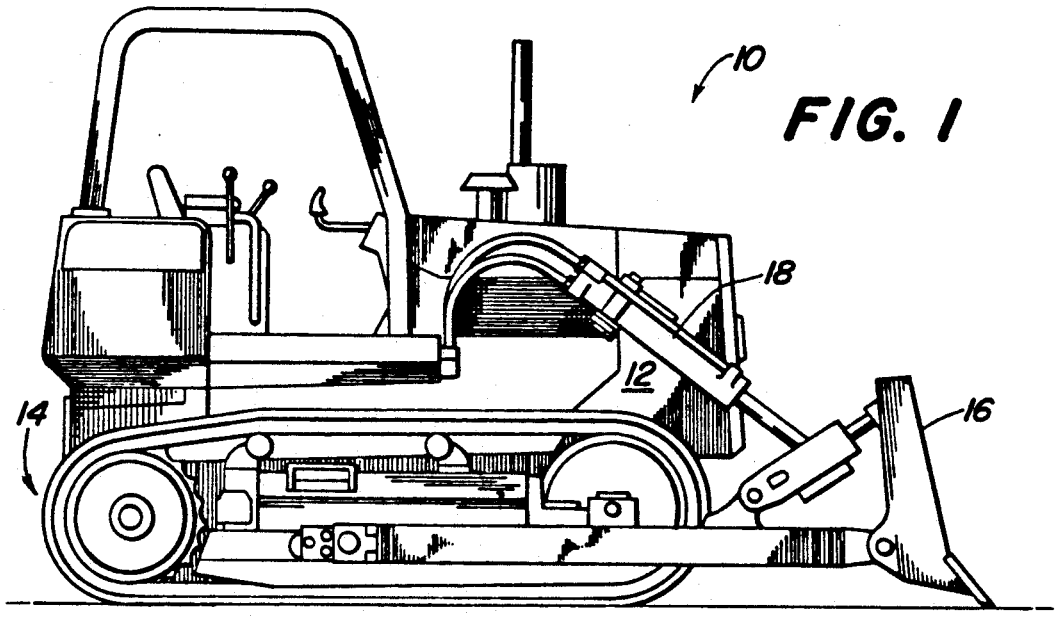
FIG. 1 is a side view of a bulldozer incorporating the present invention.

A work vehicle 10, illustrated in FIG. 1, is provided with a supporting structure 12 and ground engaging means 14. Ground engaging means 14 is a track undercarriage for propelling the vehicle over the ground. As illustrated in FIG. 1, the work vehicle is a crawler having a working implement comprising a bulldozer blade 16. The vertical position of the blade 16 is controlled by two hydraulic cylinders 18, only one shown.

The present invention is illustrated as being used in a quick drop valve for a bulldozer blade of a crawler work vehicle. Although this invention is particularly well suited to the illustrated application, it can also be used on a wheel loaders for bucket-dump and return-to-dig functions, as well as other functions. As a quick drop valve is not desirable in some applications an on-off actuation switch maybe provided to let the operator selectively engage the invention.

Figure 2:
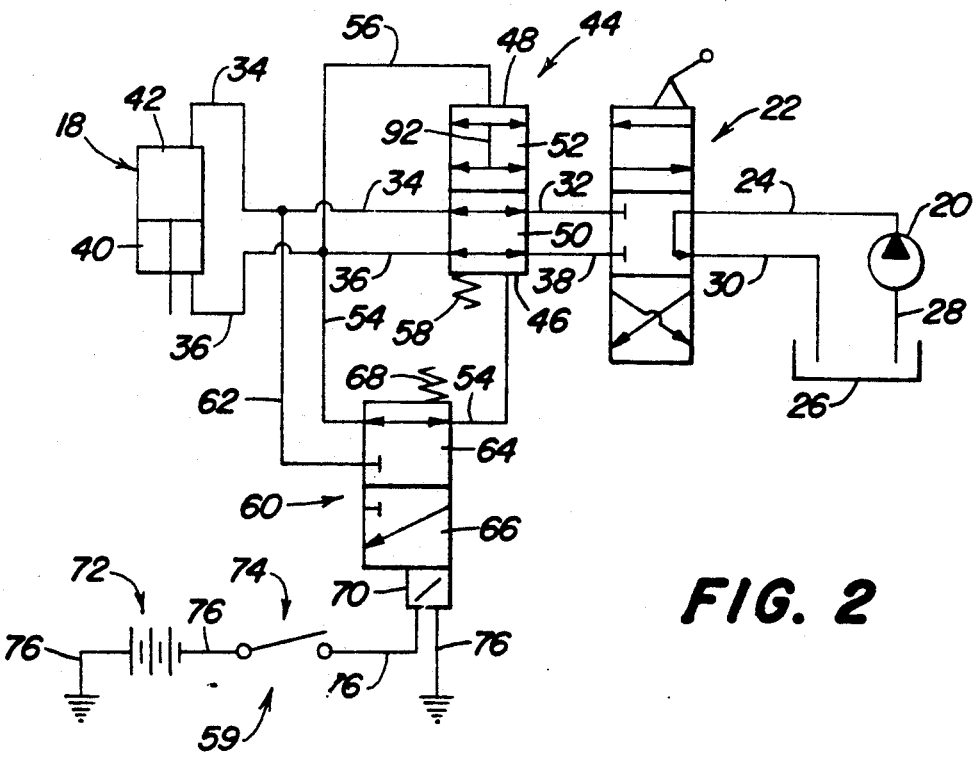
FIG. 2 is a hydraulic and electrical schematic of the present invention.

The hydraulic circuit for controlling the vertical position of the blade 16 is best illustrated in FIG. 2. A source of pressurized hydraulic fluid, pump 20, directs pressurized hydraulic fluid to a three-position four-way control valve 22 through hydraulic supply line 24. The fluid is drawn from reservoir 26 to pump 20 through suction line 28. Exhausted fluid is returned from the control valve 22 to the reservoir 26 through return line 30.

Control valve 22 controls the flow of pressurized fluid to and from hydraulic cylinder 18 through supply/return lines 32, 34, 36 and 38 allowing the operator to vertically position blade 16. The hydraulic cylinder has a lift side 40 and a drop side 42. When pressurized hydraulic fluid is applied to the lift side 40 of the hydraulic cylinder and drop side 42 is coupled to reservoir, the blade is moved in an upward direction. When pressurized fluid is applied to the drop side 42 of the hydraulic cylinder and the lift side is coupled to reservoir, the blade is moved in a downward direction.

To quicken the downward movement of the blade a quick drop valve 44 is hydraulically located between the control valve and the hydraulic cylinder. The quick drop valve has a first and second sides 46 and 48, respectively, and first and second positions 50 and 52, respectively. In its first position, illustrated in FIG. 2, the quick drop valve passes fluid directly between supply/-return lines 32 and 34, and supply/return lines 36 and 38. In its second position, the quick drop valve short circuits the flow of fluid from the lift side of the hydraulic cylinder to the reservoir and redirects it to the drop side of the hydraulic cylinder for quickly dropping the blade.

The quick drop valve is a pilot operated valve having first and second pilot lines 54 and 56. Both pilot lines are coupled to supply/return line 36 which is hydraulically coupled to the lift side of the hydraulic cylinder. The valve is also provided with biassing spring 58 for biassing the valve into its first position. As there is equal pressure being applied to the first and second sides 46 and 48 by the first and second pilot lines the valve is shifted into its first position by spring 58.

A means for triggering the quick drop valve so that it is shifted into its second position comprises an electrical circuit 59 and a two-position spring biassed solenoid valve 60 having a separate hydraulic line 62. The separate line 62 is coupled to supply/return line 34 which is hydraulically coupled to the drop side 42 of the hydraulic cylinder. The solenoid valve is provided with a first position 64 and a second position 66. In its first position, the solenoid valve allows fluid from the lift side of the hydraulic cylinder to communicate with the first side of the quick drop valve through the first pilot line 54. As the same hydraulic pressure is being applied to the second side by second pilot line 56, the quick drop valve is biassed into its first position by spring 58. The solenoid valve is provided with a spring 68 for biassing the valve into its first position illustrated in FIG. 2.

Figure 4:
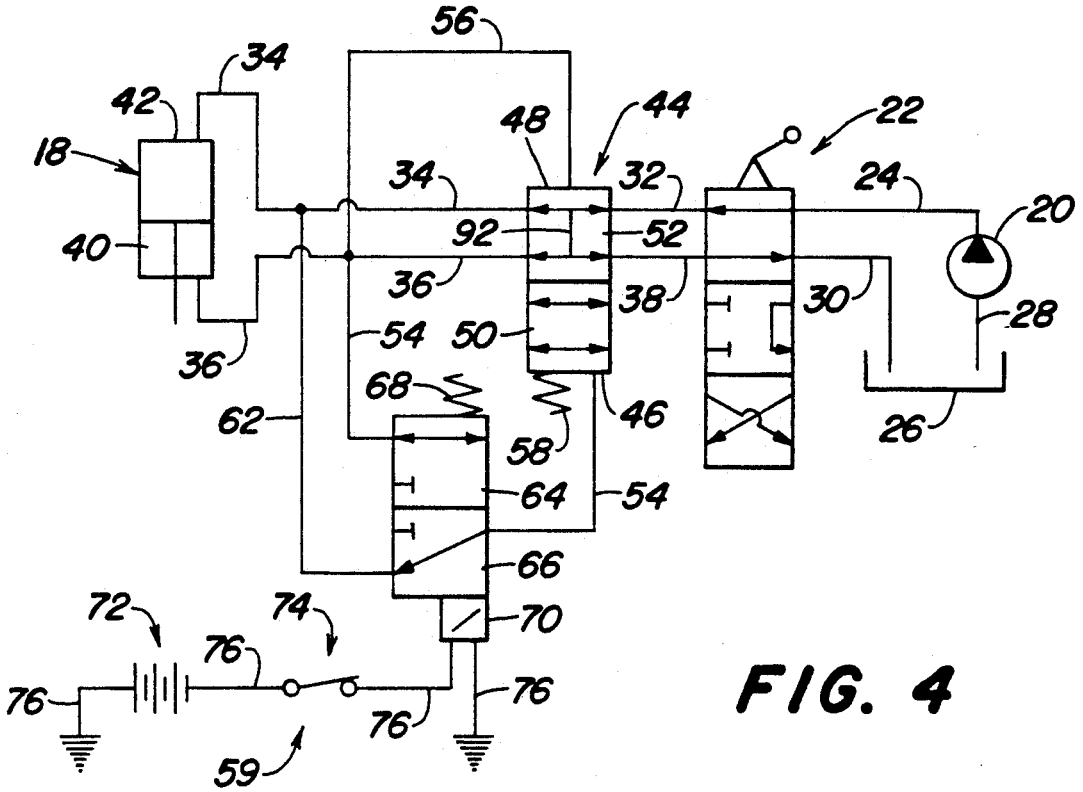
FIG. 4 is a hydraulic and electrical schematic of the present invention in its full down position.

In the triggering electrical circuit 59, a solenoid 70 is used to shift the solenoid valve 60 against the spring 68 into its second position 66. The solenoid is electrically coupled to a source of electrical energy 72 and a switch 74 by electrical lines 76. In the preferred embodiment, switch 74 would be located adjacent to the blade control lever and would be activated (closed) when the blade control lever is placed in its full down position. FIG. 4 best illustrates the hydraulic and electrical circuit of the present invention when it is shifted to its full down position.

In response to the electrical signal, the closing of switch 74 by the blade control lever, the solenoid 70 is energized shifting the solenoid valve 60 into its second position 66. In its second position, solenoid valve 60 triggers the quick drop valve 44 shifting it into its second position 52. The second position of the solenoid valve 60 couples supply/return line 34, which is hydraulically coupled to the drop side 42 of the hydraulic cylinder 18, to the first side 46 of the quick drop valve 44 by separate line 62. As first pilot line 54 is no longer coupled to the same source of pressurized fluid as second pilot line 56, quick drop valve 44 becomes unbalanced. As the hydraulic pressure applied to second side 48 of the quick drop valve 44 exceeds the hydraulic pressure applied and biassing spring force to the first side 46 of the quick drop is valve 44, the valve is shifted into its second position. In this second position the implement is more quickly dropped as exhausted fluid from lift side 40 can more easily circulate into drop side 42 through short circuit path 92 located in quick drop valve 44.

Figure 3:
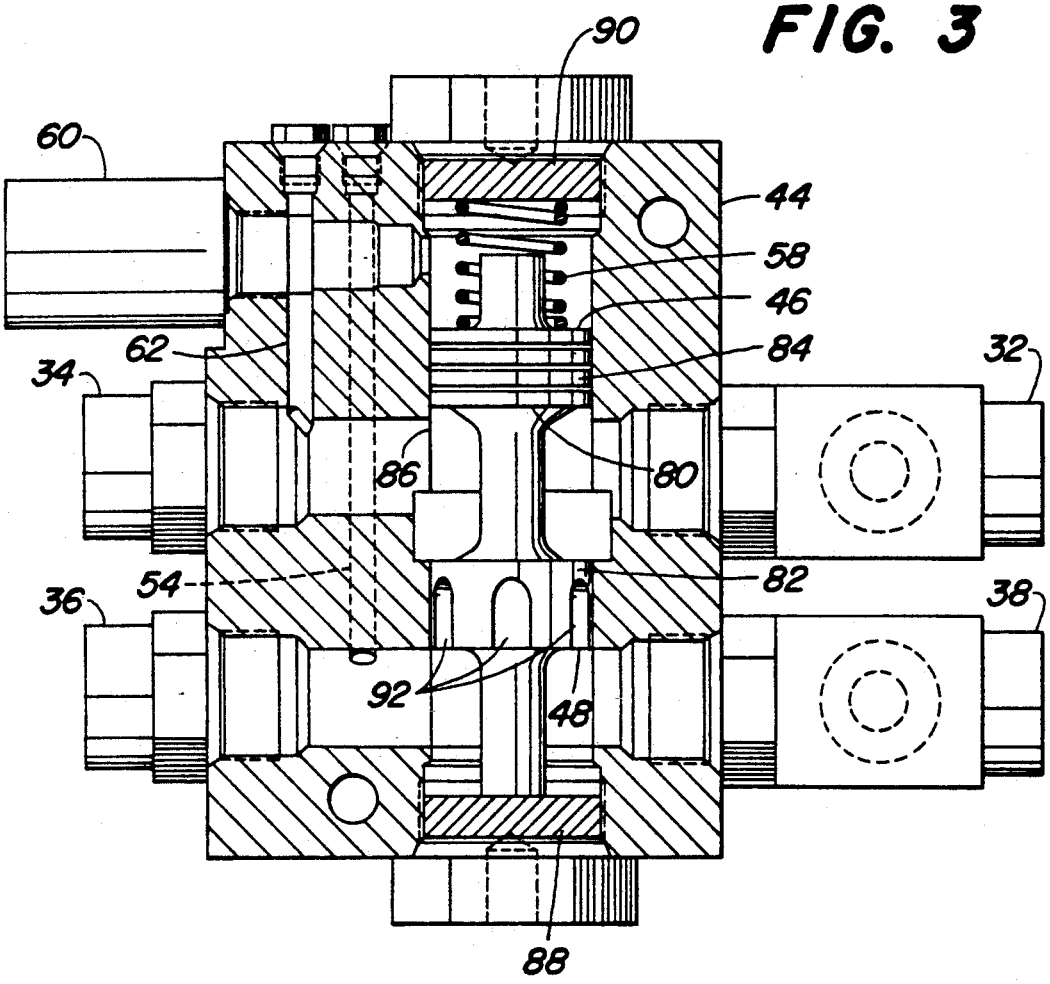
FIG. 3 is a cross section view of the subject quick drop valve.

FIG. 3 better illustrates the structure of the quick drop valve 44 and the triggering means. The quick drop valve comprises a spool 80 having first and second pistons 82 and 84. The piston is located in cylindrical bore 86 between plugs 88 and 90. Biassing spring 58 pushes against plug 90 to bias the spool downwardly so that is rests against plug 88. When the valve is triggered the spool is driven upwardly away from plug 88 so that channels 92 formed in piston 82 form a short circuit path for fluid flowing between the supply/return lines.

In another embodiment of the present invention, the triggering means comprises a solenoid for directly shifting the quick drop valve. Such a triggering configuration would eliminate the need for pilot control lines, the separate solenoid triggering valve and the separate hydraulic line.

The present invention should not be limited by the above-described embodiments, but should be limited solely by the claims that follow.

We claim:

1. A hydraulic circuit comprising a pump for pressurizing hydraulic fluid;

a hydraulic fluid reservoir for supplying hydraulic fluid to the pump;

a hydraulic cylinder to which the pressurized hydraulic fluid is directed from the pump, the hydraulic cylinder having a lift side and a drop side, the hydraulic cylinder is mechanically coupled to a working implement;

a control valve for controlling the flow of pressurized hydraulic fluid to and from the pump to the hydraulic cylinder for manipulating the working implement, the control valve is hydraulically located between the pump and the hydraulic cylinder;

a quick drop valve hydraulically located between the control valve and the hydraulic cylinder, when triggered the quick drop valve short circuits the flow of fluid from the lift side of the hydraulic cylinder to the reservoir and redirects it to the drop side of the hydraulic cylinder for quickly dropping the working implement, the quick drop valve is a pilot operated valve having first and second sides, the quick drop valve is also provided with first and second pilot lines for controlling the positioning of the valve, the first pilot line being hydraulically coupled to the first side of the quick drop valve and the second pilot line being hydraulically coupled to the second side of the quick drop valve; and means for triggering the quick drop valve by an electrical signal, the means for triggering is a two-position spring biassed solenoid valve that controls the flow of fluid through the pilot lines.

2. A hydraulic circuit as defined by claim 1 wherein the means for triggering comprises an electrical circuit having a source of electrical energy, a solenoid and a switch for controlling the energization of the solenoid.

3. A hydraulic circuit as defined by claim 1 is hydraulically coupled to the drop side of the hydraulic cylinder by a separate hydraulic line and the pilot lines are hydraulically coupled to the lift side of the hydraulic cylinder.

4. A hydraulic circuit as defined by claim 3 wherein the solenoid valve is electrically coupled to a source of electrical energy, a switch controls the flow of electricity from the source of electrical energy to the solenoid valve, the source of electrical energy energizes the solenoid thereby shifting the solenoid valve.

5. A hydraulic circuit as defined by claim 4 wherein the solenoid valve has two positions, the first position permits the flow of fluid from the lift side of the hydraulic cylinder to freely communicate with the first and second sides of the quick drop valve, and the second position which hydraulically couples the drop side of the hydraulic cylinder to the second side of the quick drop valve.

6. A work vehicle for performing a work operation, the vehicle comprising:

a supporting structure;

ground engaging means coupled to the supporting structure for propelling and supporting the supporting structure;

a working implement mounted to the supporting structure for performing a work operation;

a pump for pressurizing hydraulic fluid;

a hydraulic fluid reservoir for supplying hydraulic fluid to the pump;

a hydraulic cylinder to which the pressurized hydraulic fluid is directed from the pump, the hydraulic cylinder having a lift side and a drop side, the hydraulic cylinder is mechanically coupled to the working implement;

a control valve for controlling the flow of pressurized hydraulic fluid to and from the pump to the hydraulic cylinder for manipulating the working implement, the control valve is hydraulically located between the pump and the hydraulic cylinder;

a quick drop valve hydraulically located between the control valve and the hydraulic cylinder, when triggered the quick drop valve short circuits the flow of fluid from the lift side of the hydraulic cylinder to the reservoir and redirects it to the drop side of the hydraulic cylinder for quickly dropping the working implement, the quick drop valve is a pilot operated valve having first and second sides, the quick drop valve is also provided with first and second pilot lines for controlling the positioning of the valve, the first pilot line being hydraulically coupled to the first side of the quick drop valve and the second pilot line being hydraulically coupled to the second side of the quick drop valve; and means for triggering the quick drop valve by an electrical signal, the means for triggering is a two-position spring biassed solenoid valve that controls the flow of fluid through the pilot lines.

7. A work vehicle as defined by claim 6 wherein the means for triggering comprises an electrical circuit having a source of electrical energy, a solenoid and a switch for controlling the energization of the solenoid.

8. A work vehicle as defined by claim 7 is hydraulically coupled to the drop side of the hydraulic cylinder by a separate hydraulic line and the pilot lines are hydraulically coupled to the lift side of the hydraulic cylinder.

9. A work vehicle as defined by claim 8 wherein the solenoid valve is electrically coupled to a source of electrical energy, a switch controls the flow of electricity from the source of electrical energy to the solenoid valve, the source of electrical energy energizes the solenoid thereby shifting the solenoid valve.

10. A work vehicle as defined by claim 9 wherein the solenoid valve has two positions, the first position permits the flow of fluid from the lift side of the hydraulic cylinder to freely communicate with the first and second sides of the quick drop valve, and the second position which hydraulically couples the drop side of the hydraulic cylinder to the second side of the quick drop valve.

11. An earth moving vehicle comprising:

a supporting structure;

ground engaging means coupled to the supporting structure for propelling and supporting the supporting structure;

a bulldozer blade implement mounted to the supporting structure for scraping and moving earth;

a pump for pressurizing hydraulic fluid;

a hydraulic fluid reservoir for supplying hydraulic fluid to the pump;

a hydraulic cylinder to which the pressurized hydraulic fluid is directed from the pump, the hydraulic cylinder having a lift side and a drop side, the hydraulic cylinder is mechanically coupled to the bulldozer blade for raising and lowering the blade;

a control valve for controlling the flow of pressurized hydraulic fluid to and from the pump to the hydraulic cylinder for manipulating the bulldozer blade, the control valve is hydraulically located between the pump and the hydraulic cylinder;

a quick drop valve hydraulically located between the control valve and the hydraulic cylinder, when triggered the quick drop valve short circuits the flow of fluid from the lift side of the hydraulic cylinder to the reservoir and redirects it to the drop side of the hydraulic cylinder for quickly dropping the bulldozer blade, the quick drop valve is a pilot operated valve having first and second sides, the quick drop valve is also provided with first and second pilot lines for controlling the positioning of the valve, the first pilot line being hydraulically coupled to the first side of the quick drop valve and the second pilot line being hydraulically coupled to the second side of the quick drop valve; and means for triggering the quick drop valve by an electrical signal, the means for triggering is a two-position spring biassed solenoid valve that controls the flow of fluid through the pilot lines.

12. An earth moving vehicle as defined by claim 11 wherein the means for triggering comprises an electrical circuit having a source of electrical energy, a solenoid and a switch for controlling the energization of the solenoid.

* * * * *